US009809233B2

(12) United States Patent
Kendall et al.

(10) Patent No.: US 9,809,233 B2
(45) Date of Patent: Nov. 7, 2017

(54) VEHICLE BODY AND MANUFACTURING METHOD

(75) Inventors: Harold Kendall, Erie, PA (US); Daniel Ganzer, Erie, PA (US); Zuoguang Liu, Shanghai (CN); Aiqin Jiang, Shanghai (CN)

(73) Assignee: General Electric Company, Schenectady, NY (US)

( * ) Notice: Subject to any disclaimer, the term of this patent is extended or adjusted under 35 U.S.C. 154(b) by 387 days.

(21) Appl. No.: 14/373,226

(22) PCT Filed: Jan. 19, 2012

(86) PCT No.: PCT/CN2012/070602

§ 371 (c)(1),
(2), (4) Date: Jul. 18, 2014

(87) PCT Pub. No.: WO2013/107023

PCT Pub. Date: Jul. 25, 2013

(65) Prior Publication Data

US 2015/0000556 A1 Jan. 1, 2015

(51) Int. Cl.
*B61D 17/08* (2006.01)
*B61D 17/00* (2006.01)
(Continued)

(52) U.S. Cl.
CPC ..... *B61D 17/08* (2013.01); *B61C 17/00* (2013.01); *B61D 17/00* (2013.01); *B61F 1/00* (2013.01); *Y10T 29/49622* (2015.01)

(58) Field of Classification Search
CPC ..... B61F 1/00; B61C 17/00; B61D 17/08; B61D 17/10
(Continued)

(56) References Cited

U.S. PATENT DOCUMENTS 5,730,063 A * 3/1998 Forbes ..... B61D 3/20 105/355
5,758,584 A 6/1998 Saxton
(Continued)

FOREIGN PATENT DOCUMENTS

CN 1394778 A 2/2003
CN 1843819 A 10/2006
(Continued)

OTHER PUBLICATIONS

International Search Report dated Nov. 1, 2012 which was issued in connection with PCT Patent Application No. PCT/CN2012/070602 which was filed on Jan. 19, 2012.
(Continued)

*Primary Examiner* — Zachary Kuhfuss
(74) *Attorney, Agent, or Firm* — Global Patent Operation; John A. Kramer

(57) ABSTRACT

An embodiment of the present invention relates to a method of manufacturing a vehicle body. The method includes coupling a frame assembly to a platform, wherein the platform is in a cambered and unloaded condition, and wherein the frame assembly has a degree of play at coupling points with the platform and securing the coupling points to eliminate the degree of play and thereby to provide substantially zero residual stress in the vehicle body in the cambered condition.

18 Claims, 8 Drawing Sheets

(51) Int. Cl.
*B61C 17/00* (2006.01)
*B61F 1/00* (2006.01)

(58) Field of Classification Search
USPC ..... 105/355
See application file for complete search history.

(56) References Cited

U.S. PATENT DOCUMENTS

| | | | | |
|---|---|---|---|---|
| 6,205,932 | B1 * | 3/2001 | Khattab | B61D 3/18 105/355 |
| 6,279,217 | B1 | 8/2001 | Gallinger et al. | |
| 6,494,146 | B1 | 12/2002 | Landrum et al. | |
| 6,877,440 | B1 * | 4/2005 | Kilian | B60P 1/286 104/247 |
| 2003/0172838 | A1 * | 9/2003 | Forbes | B61D 3/18 105/355 |
| 2004/0011243 | A1 | 1/2004 | Forbes et al. | |
| 2005/0211128 | A1 * | 9/2005 | Dawson | B61D 3/182 105/355 |
| 2006/0225604 | A1 | 10/2006 | Nakamura et al. | |
| 2010/0024679 | A1 | 2/2010 | Khairnar et al. | |
| 2013/0263757 | A1 * | 10/2013 | Rezaei | B61D 17/00 105/355 |

FOREIGN PATENT DOCUMENTS

| | | | |
|---|---|---|---|
| CN | 201189864 | Y | 2/2009 |
| CN | 102009698 | A | 4/2011 |
| JP | 2005059729 | A | 3/2005 |
| JP | 2010167862 | A | 8/2010 |
| WO | 2011157197 | A1 | 12/2011 |

OTHER PUBLICATIONS

Unofficial English Translation of Chinese Office Action issued in connection with corresponding CN Application No. 201280067507.8 on Feb. 2, 2016.

* cited by examiner

VEHICLE BODY AND MANUFACTURING METHOD

FIELD OF THE INVENTION

Embodiments of the invention relate generally to a vehicle body. Other embodiments relate to a carbody of a rail vehicle having a reduced weight, and a method of manufacturing the same.

BACKGROUND OF THE INVENTION

In the rail industry, rail vehicles are utilized to transport passengers and/or cargo from location to location on a track. Typically, a locomotive provides the motive power for a train. Locomotives often have one of two body styles, namely, a platform style (also referred to as a cowl unit style) or a carbody unit style. In the case of a platform-style locomotive, the locomotive has full-width enclosing bodywork. The bodywork is simply a casing or a tent-like structure and is not load bearing. Instead, all the strength of a platform-style locomotive is in the locomotive's platform structure/frame, beneath the floor. Locomotives having a platform body style are often quite heavy, as large beams and other substantial structural members are needed to support the full weight of the locomotive components such as the engine, fuel, alternator, cooling system, etc.

In contrast to a platform design, a carbody unit, or simply carbody, derives its structural strength from a bridge-truss framework in the sides and roof, which cover the full width of the locomotive. When constructing the carbody, residual stresses build up due to the manufacturing process and/or shape of the framework. Accordingly, in order to safely support the full weight of the locomotive components, the carbody framework must actually be over-engineered to account for residual stresses in the carbody. This over-engineering may take the form of thicker frame members, resulting in added weight.

In certain instances, however, weight of the locomotive is a primary concern. For instance, rail safety organizations may have maximum weight requirements. In particular, the weight of a locomotive may be a primary concern when traveling over certain bridges or other areas of track. Accordingly, it may be desirable to reduce the weight of a locomotive by eliminating residual stresses associated with the manufacture of the locomotive, thus eliminating the need to over-engineer the structural members of the carbody to compensate for residual stresses therein.

BRIEF DESCRIPTION OF THE INVENTION

An embodiment of the present invention relates to a method of manufacturing a vehicle body. The method includes coupling a frame assembly to a platform, wherein the platform is in a cambered and unloaded condition, and wherein the frame assembly has a degree of play (e.g., non-zero degree of play) at coupling points with the platform. (The vehicle body comprises the frame assembly and the platform coupled together.) The method further includes securing the coupling points to eliminate the degree of play and thereby to provide substantially zero residual stress in the vehicle body in the cambered condition.

Another embodiment of the present invention relates to a vehicle body. The vehicle body includes an under frame that is movable under load between a cambered position and a non-cambered position and an upper frame secured to the under frame. When the under frame is in the cambered position and the upper frame is secured to the under frame there is substantially zero residual stress present in both the upper frame and the under frame.

Another embodiment of the present invention relates to a vehicle having a body. The vehicle body includes platform assembly movable under load between a cambered position and a substantially non-cambered position, a frame assembly having a plurality of structural members, and a first slip joint plate securing the upper frame assembly to the platform assembly. The first slip joint plate is matingly engagable to at least one of the structural members of the frame assembly and is fixedly attached to the platform assembly such that substantially zero residual stress is exhibited in the body when the platform is in the cambered position.

According to another embodiment of the present invention, a method includes assembling a frame of a vehicle in a substantially non-cambered position, and assembling a platform of a vehicle in a cambered position. The method further comprises securing the non-cambered frame to the cambered platform with little or no stress between the frame and the platform when the vehicle (comprising the frame secured to the platform) is in the cambered position, and loading the cambered vehicle to reduce the degree of camber to about zero degrees of camber.

According to yet another embodiment of the present invention, a method for reducing the weight of a vehicle body includes selecting a structure and materials that are only necessary to provide a substantially 1:1 ratio of calculated stress to allowable stress in the vehicle body, wherein the calculated stress includes substantially zero residual stress. The method may further comprise manufacturing the vehicle body based on the selected structure and materials.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
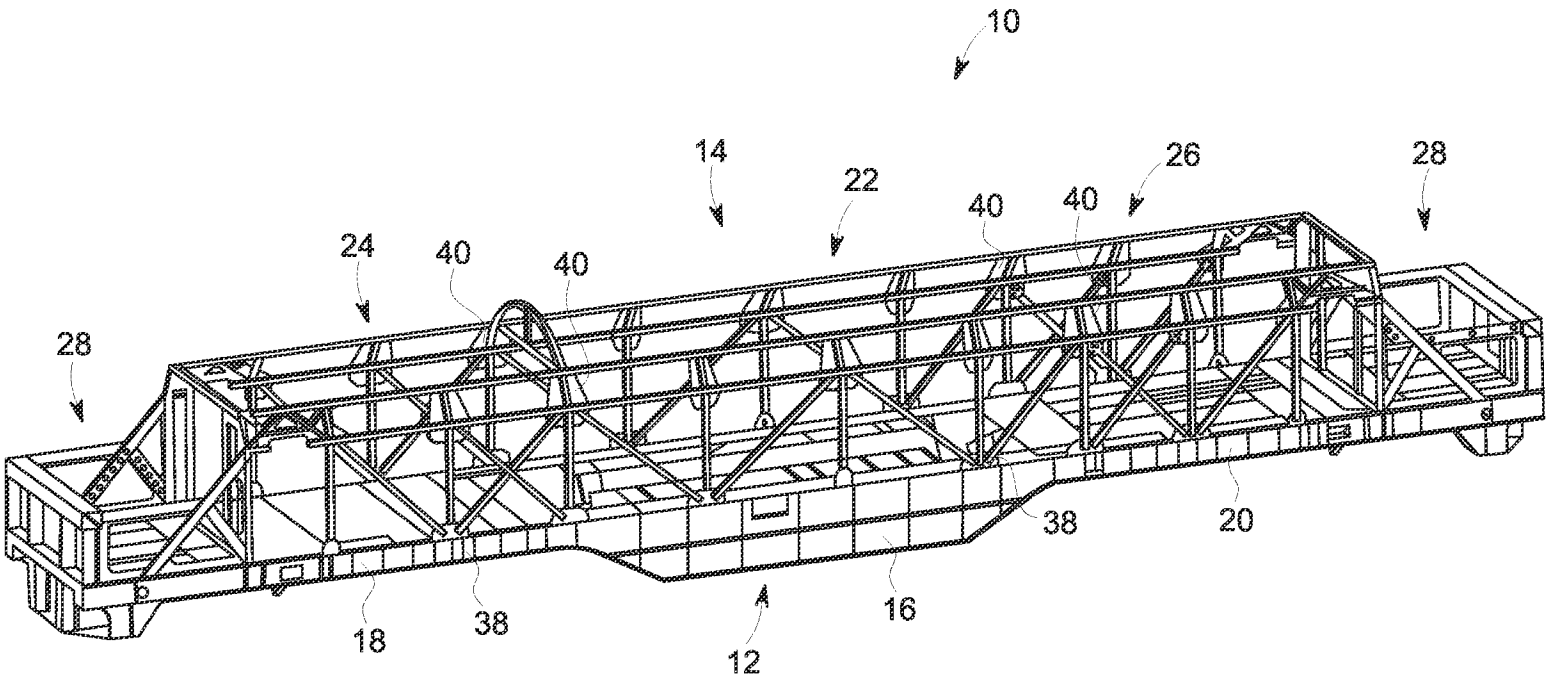
FIG. 1 is a perspective view of a locomotive carbody according to an embodiment of the present invention.
Figure 2:
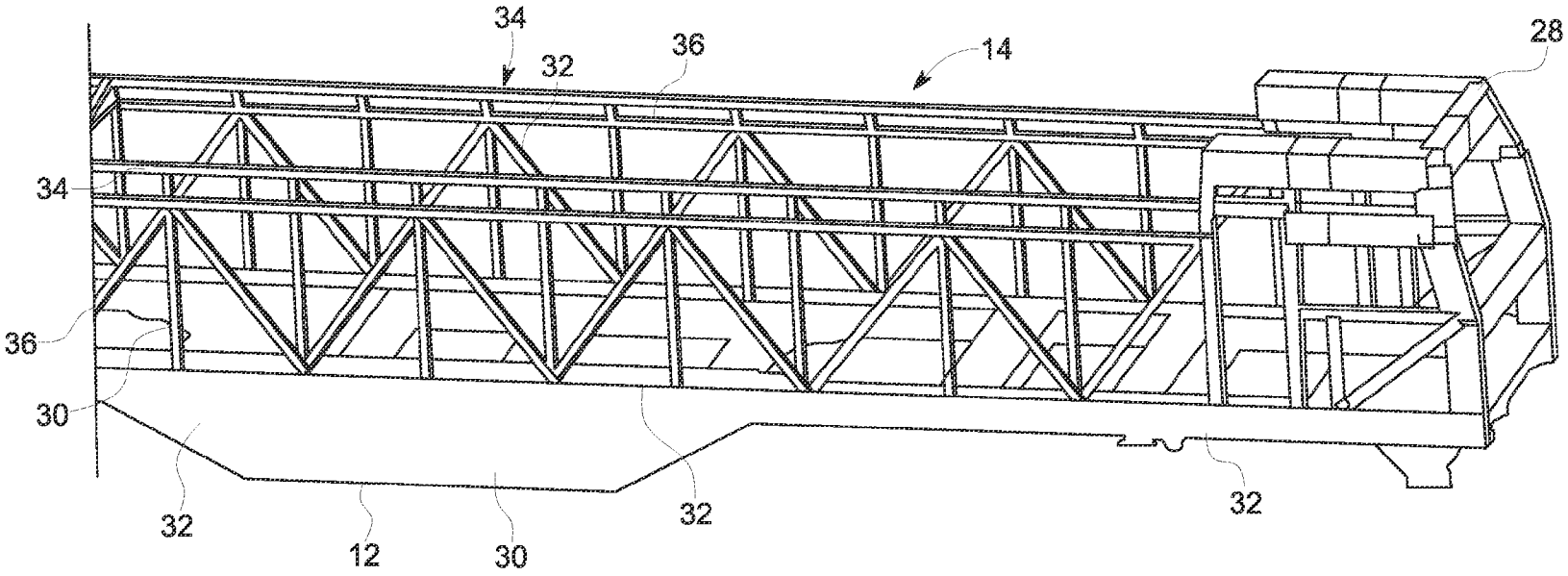
FIG. 2 is an enlarged, perspective view of a portion of the locomotive carbody of FIG. 1.

Reference will be made below in detail to exemplary embodiments of the invention, examples of which are illustrated in the accompanying drawings. Wherever possible, the same reference numerals used throughout the drawings refer to the same or like parts. Although exemplary embodiments of the present invention are described with respect to locomotives, embodiments of the invention are also applicable for use with rail vehicles generally, meaning any vehicle configured for traveling along a rail or track, or with other vehicles generally.

Embodiments of the invention relate to a carbody of a rail vehicle having a reduced weight and a method of manufacturing such a carbody. The carbody includes an under frame and an upper frame secured to the under frame by a plurality of welds. The under frame is manufactured in a cambered position and the upper frame is secured to the under frame while the under frame is in the cambered position to ensure that no residual stresses are created in the carbody.

Figure 3:
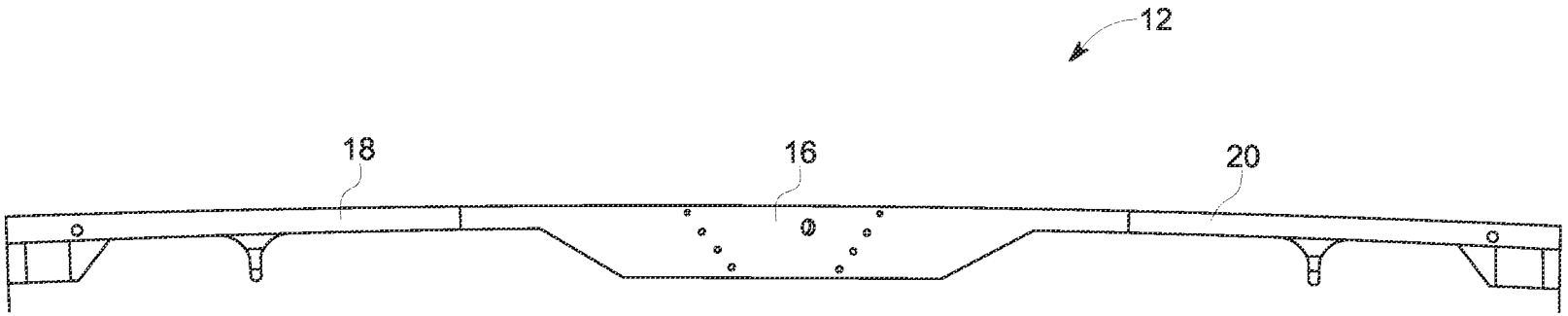
FIG. 3 is a side elevational view of an under frame portion of the locomotive carbody of FIG. 1, shown in a cambered state.
Figure 6:
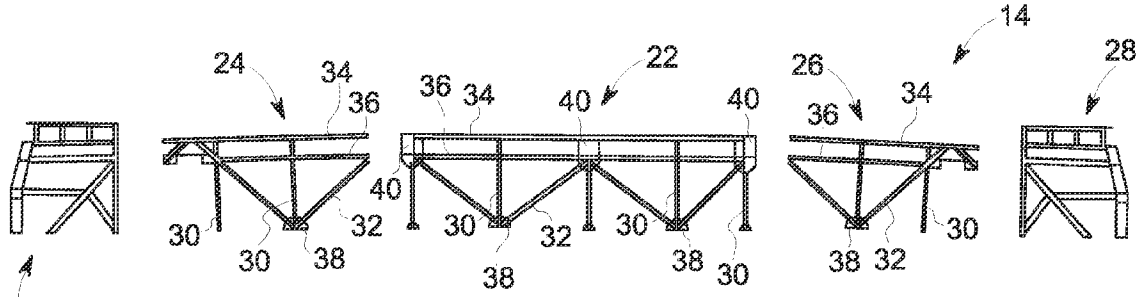
FIG. 6 is side elevational view of an upper frame portion of the locomotive carbody of FIG. 1, illustrating the individual sections thereof.
Figure 7:
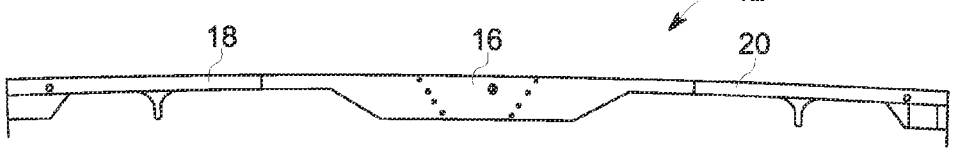
FIG. 7 is a side elevational view of the under frame portion of FIG. 3.

FIG. 1 illustrates an embodiment of a carbody 10 of a rail vehicle. The carbody 10 generally includes a under frame 12 and an upper frame 14 secured to the under frame 12 on an upper surface of the under frame 12. The under frame 12 is also referred to herein as the "platform" or "platform assembly" and the upper frame 14 is referred to as the "frame" or "frame assembly." As shown in FIGS. 1 and 3, the under frame 12 includes of a plurality of sections, an under frame center section 16 and a pair of under frame end sections 18, 20 affixed to respective ends of the under frame center section 16. In an embodiment, the center section 16 includes a cavity for housing the fuel tank. The upper frame 14 also generally includes a plurality of distinct sections. In an embodiment, as shown in FIGS. 1 and 6, the upper frame 14 includes a center section 22 and a pair of end sections 24, 26. The end sections 24, 26 are secured to respective ends of the center section 22, as discussed in detail below. As illustrated in the drawings, center section 22 is positioned substantially on, and generally lines up with, the center section 16 of the under frame 12, and the end sections 24, 26 are positioned substantially on, and generally line up with, the respective end sections 18, 20 of the under frame 12.

As further shown in FIG. 1, the carbody may have a pair of operator cabs 28 positioned on the ends of the under frame adjacent, and secured to, the respective end sections 24, 26 of the upper frame. In an embodiment, only one end of the carbody may have an operator cab, without departing from the broader aspects of the present invention. The center section 22 and end sections 24, 26 of the upper frame 14, as well as the operator cabs 28, are secured to one another through welds and slip joint plates, as discussed hereinafter, to create a truss-like frame enclosure.

Figure 10:
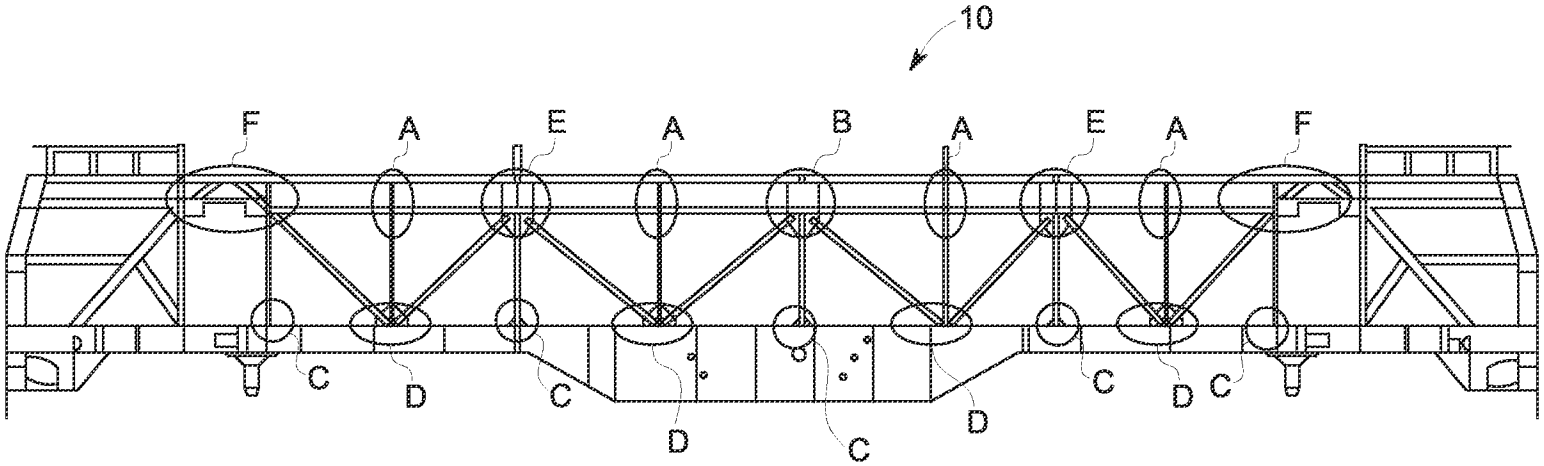
FIG. 10 is a side elevational view of the locomotive carbody of FIG. 1, shown in a non-cambered fully-serviced state, and illustrating a weld sequence.

As further shown in FIG. 1, and with reference to FIG. 6, the end sections 24, 26 and the center section 22 of the upper frame 14 are comprised of a plurality of structural truss members that bear a portion of the load placed on the carbody 10, as discussed in detail below. In particular, the end sections 24, 26 and center section 22 include a plurality of vertical members 30, and a plurality of diagonal members 32. They also include an upper cant rail 34 and a lower cant rail 36 that span the length of the end and center sections 22, 24, 26, respectively. The vertical members 30 may be welded to the upper and lower cant rails 34, 36 at weld location A, as shown in FIG. 10. As will be readily appreciated, the upper and lower cant rails 34, 36, vertical members 32, and diagonal members 34 make up the sidewalls of the end and center sections of the upper frame 14.

Figure 11:
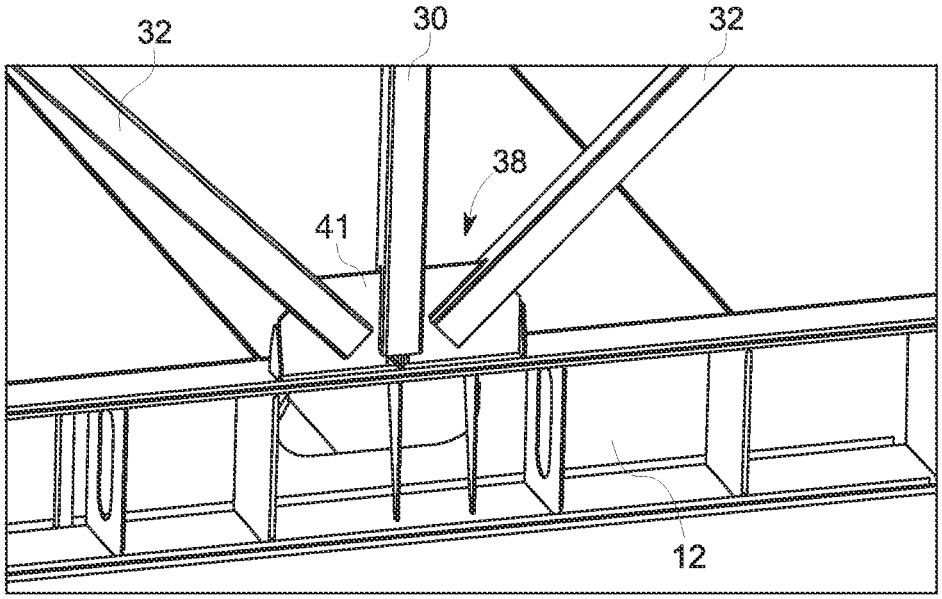
FIG. 11 is an enlarged, perspective view of a slip joint utilized to connect the upper frame portion to the under frame portion.

As best shown in FIG. 6, each of the end sections 24, 26 of the upper frame 14 includes at least one lower slip joint plate 38, on each sidewall thereof, located where one of the vertical members 30 and two of the diagonal members 32 converge. Likewise, the center section 22 of the upper frame also includes at least one lower slip joint plate 38, on each sidewall thereof, where one the vertical members 30 and two of the diagonal members 32 converge. As shown in FIG. 11, each lower slip joint plate 38 has a flange 41, which is welded directly to the under frame 12, as discussed below. The vertical members 30 and the diagonal members 32 that converge on the lower slip joint plate 38 each have a longitudinal slot allowing them to be slidably received on the flange 41 of the lower slip joint plate 38. The longitudinal slots are oriented in the center of the vertical and diagonal members 30, 32, respectively, and therefore provide for a non-eccentric load path.

With further reference to FIG. 6, the center section 22 of the upper frame 14 also includes a plurality of upper slip joint plates 40. As shown therein, the center section 22 includes a pair of slip joint plates 40 located at opposed ends of the center section 22. Each upper slip joint plate 40 mates with an upper member 30, a diagonal member 32, and the upper and lower cant rails 34, 36 of the center section 22, and is configured to matingly engage the upper and lower cant rails 34, 36 and a diagonal 32 of one of the end sections 24, 26 of the upper frame 14 to join the end sections 24, 26 and the center section 22 together, as discussed hereinafter. The center section 22 may also include a center slip joint plate that connects a pair of diagonal members 32, a vertical member 30, and the upper and lower cant rails 34, 36 at weld location B, as shown in FIG. 10.

Figure 12:
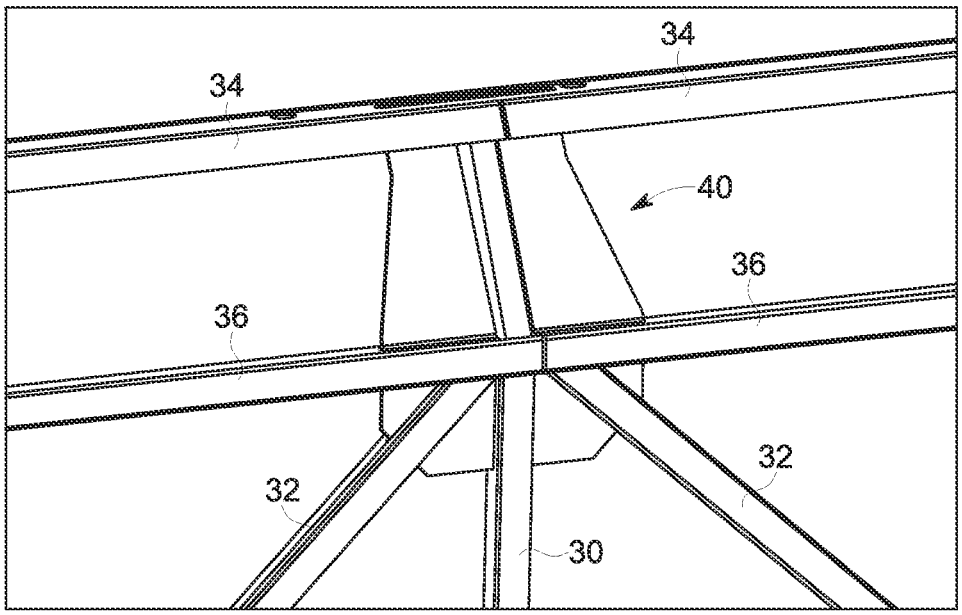
FIG. 12 is an enlarged, perspective view of a slip joint utilized to connect the individual sidewall sections of the upper frame portion to one another.

Turning now to FIG. 12, as with the lower slip joint plates 38, the vertical members 30, diagonal members 32, and upper and lower cant rails 34, 36 that converge on the upper slip joint plates 40 have a longitudinal slot in the ends thereof. As discussed above, this longitudinal slot allows the vertical members 30, diagonal members 32, and upper and lower cant rails 34, 36 to be slidably received by a flange of the upper slip joint plate 40 and provides for a non-eccentric load path.

Figure 4:
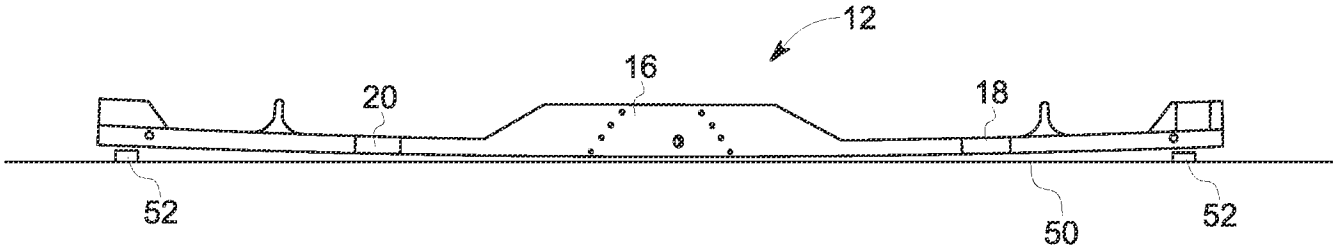
FIG. 4 is a side elevational view of the under frame portion of FIG. 3 positioned on a first manufacturing fixture.

With reference to FIGS. 4-10, a method for manufacturing or constructing the carbody 10 will be discussed. With reference to FIG. 4, the under frame 12 is first manufactured in a first fixture, such as backbone fixture 50. As shown therein, the backbone fixture includes a plurality of vertical stops 52 with vertical offsets to permit the under frame 12 to be manufactured with a predetermined amount of camber. The magnitude of camber may be predetermined by finite element analysis or other like methods, and based upon expected dead load values. The under frame assembly is manufactured in three sections, as discussed above (center section 16 and two end sections 18, 20) that are positioned upside-down in the backbone fixture 50 and welded together to produce a unitary assembly having a positive camber (albeit in the upside-down position in the backbone assembly 50). In an embodiment, the three sections begin as flat sections, i.e., without camber, which are then welded into camber on the backbone fixture such that there exists zero nominal stress in the completed under frame 12. In particular, when welded together, the center section 16 of the under frame 12 is generally flat and oriented horizontally, while the end sections 18, 20 extend at downward angles from the respective ends of the center section 16. In an embodiment, the three sections may be pre-configured with a positive camber and then welded together on the backbone fixture. In any case, in the cambered position, substantially zero residual stress is present in the under frame 12.

Figure 5:
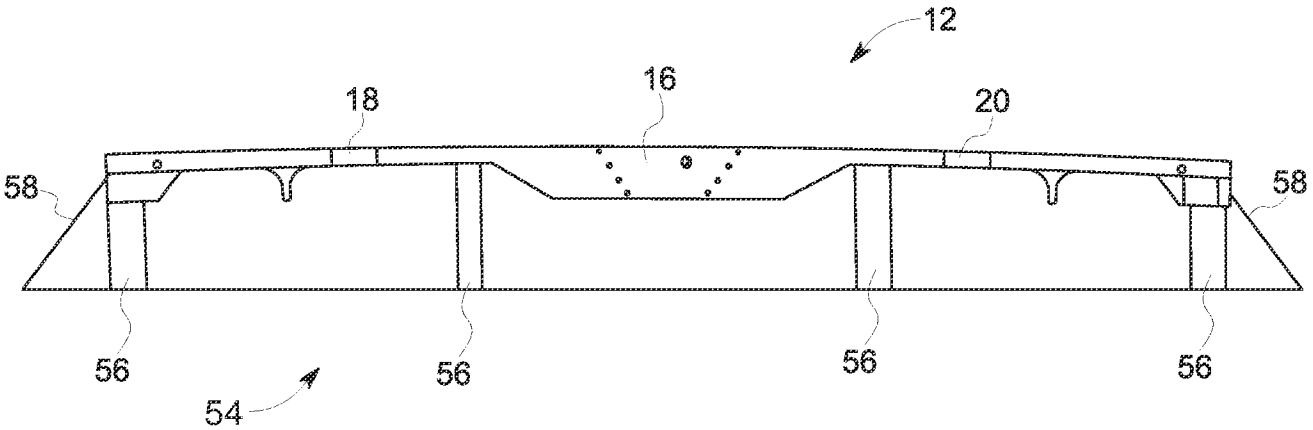
FIG. 5 is side elevational view of the under frame portion of FIG. 3 positioned on a second manufacturing fixture.

With reference to FIG. 5, the welded under frame 12, in its cambered state, is then transferred to a second fixture, i.e., platform fixture 54, having vertical stops 56 with heights corresponding to the magnitude of camber in the under frame 12. As will be readily appreciated, the vertical stops 56 function to hold the camber in the under frame 12 during subsequent assembly steps. In an embodiment, turnbuckles 58 may be utilized to temporarily secure the ends of the under frame 12 to the floor to help eliminate deformations due to weld heat in subsequent welding steps, as discussed in detail hereinafter. As shown therein, end sections 18, 20 extend at a general downward angle from the substantially horizontal center section 16.

Turning now to FIG. 6, the end sections 24, 26 and center section 22 of the upper frame 14 are manufactured flat, i.e., without camber, in a third fixture. Importantly, in an embodiment, as discussed above, the ends of the end sections 24, 26 and center section 22 of the upper frame 14 match up with division lines, i.e., the joining lines, of the under frame sections 16, 18, 20 when placed on the upper surface of the under frame 12. As discussed above, each end section 24, 26 is manufactured with at least one lower slip joint plate 38, as shown in FIG. 6. In addition, the center section 22 is manufactured with a plurality of upper slip joint plates 40, two of which extend from the ends of the center section 22 and function to join the center section 22 to the end sections 22, 24, as discussed below. Each of members 30, 32 or cant rails 34, 36 converging on either an upper or lower slip joint plate 38, 40 are only tack welded to the slip joint plates 38, 40 at this point to hold the sidewall geometry in place during transfer from one fixture to another for assembly, and allows the weld to be broken so that the joint plates 38, 40 can slip to a final position before final welding, i.e., allowing for a "degree of play," as discussed in detail below.

Figure 8:
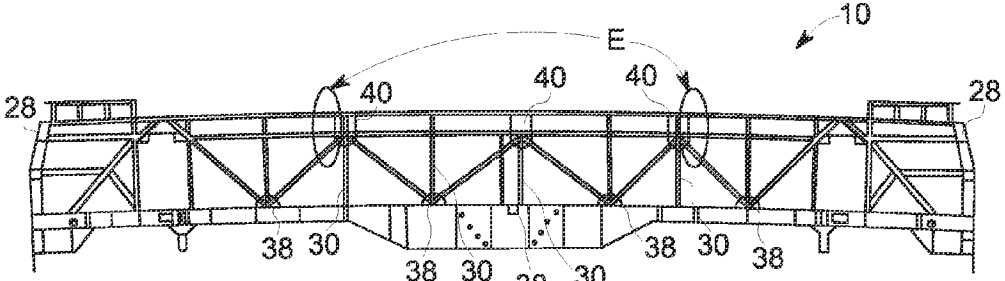
FIG. 8 is a side elevational view of the locomotive carbody of FIG. 1, shown in an assembled state.
Figure 9:
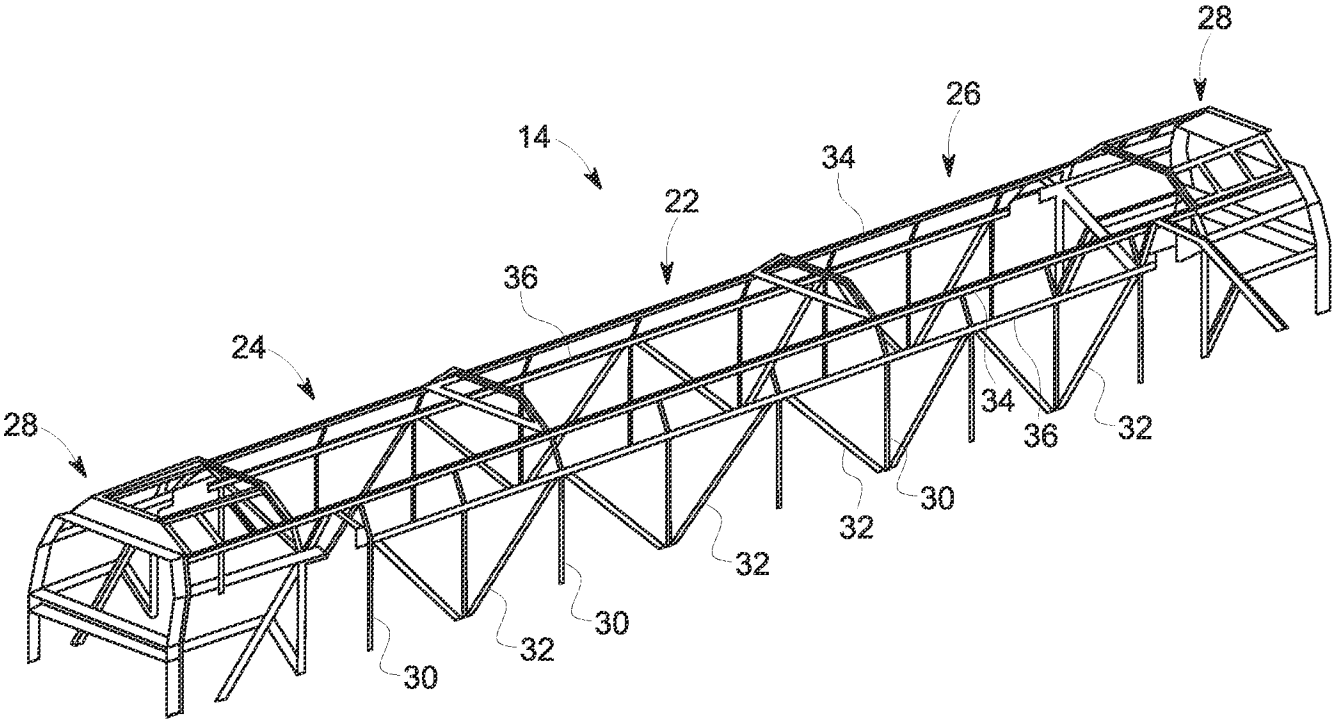
FIG. 9 is a perspective view of the upper frame portion of FIG. 6, illustrating the individual sections joined together.

Turning now to FIG. 8, the center section 22 of the upper frame 14 is positioned atop the under frame 12 such that the vertical members 30 of the center section 22 are oriented substantially perpendicular to the top surface of the center section 16 of the under frame 12, and such that the upper and lower cant rails 34, 36 of the center section 22 are substantially parallel to the upper surface of the center section 12 of the under frame 12. The vertical members 30 are then welded directly to the top surface of the center section 16 of the under frame 12, at weld locations C, as shown in FIG. 10.

In the event that the lower slip joint plates 38 of the center section do not lay in flat registration with the top surface of the center section 16, the tack welds holding the diagonal and vertical members 32, 30 to the lower slip joint plate 38 may be broken (such as by grinding) so that the lower slip joint plate 38 may slide into registration with the top surface of the center section 16. As will be readily appreciated, by breaking the tack welds, a degree of play between the slip joint plate 38 and the vertical and diagonal members which converge on the slip joint 38 is permitted. The lower slip joint plates 38 can then be welded directly to the under frame 12, at weld locations C and D, as shown in FIG. 10. Lastly, once the lower slip joint plate 38 is welded to the center section 16, the diagonals 32 (and any applicable vertical members 30) can then be finally welded to the lower slip joint plate 38 on both sides of the slot in the members to create a permanent bond.

Once the center section 22 is secured to the under frame 12, the end sections 24, 26 of the upper frame 14 are positioned atop the under frame 12 adjacent respective ends of the center section 22 such that the vertical members 30 of each end section 24, 26 are substantially perpendicular to the angled surface of the end sections 18, 20 of the under frame 12 on which they are positioned. In addition, in this orientation, the upper and lower cant rails 34, 36 of the end sections 24, 26 are substantially parallel to the angled top surface (i.e., the angle of the end sections 18, 20 with respect to the center section 16) of the under frame end sections 18, 20. Once properly aligned, the vertical members 30 of the end sections 24, 26 are welded to the under fame 12. In an embodiment, the bottom ends of vertical members 30 also have a slip joint between the vertical members 30 and the under frame 12 at weld location C. In particular, smaller slip joint plates at weld locations C, similar to slip joint plates 38, accept vertical members 30 only.

As with the center section 22 above, in the event that the lower slip joint plates 38 of the respective end sections 24, 26 do not lay in flat registration with the top, angled surface of the end sections 18, 20 of the under frame 12, the tack welds joining the vertical members 30 and diagonal members 32 to the lower slip joint plates 38 may be broken (again, such as by grinding) so that the lower slip joint plates 38 can be moved into flat registration with the top surface of the respective end sections 18, 20. As discussed above, the lower slip joint plates 38 may then be welded to the under frame 12 and the diagonals 32 and any vertical member 30 can then be finally welded to the lower slip joint plate 38 on both sides of the slot in the members to create a permanent attachment, at weld location D.

With further reference to FIG. 8, once the upper frame sections 22, 24, 26 are in their final, correct position, the diagonals 32, upper cant rails 34, and lower cant rail 36 of the end sections 24, 26 are permanently welded to the upper slip joint plates 40 extending from the ends of the center section 22, at weld location E, as shown in FIG. 10, to join the end sections 24, 26 to the center section 22. As with the lower slip joint plate 38, the upper slip joint plates 40 permit a degree of play between the ends sections 24, 26 and the center section 22.

In an embodiment, the operator cabs 28 may also be secured to the carbody 10 through welding at weld location F, as shown in FIG. 10. In this embodiment, by welding the end sections 24, 26 to the operator cabs at the cant rails 34, 36, the load may be passed from the sidewalls of the center and end sections 22, 24, 26 to the operator cabs 28.

As will be readily appreciated, in this finally assembled state, in the cambered position, substantially zero (or minimal) residual stress exists in the carbody 10. The carbody 10 can then be transferred to a fourth fixture, such as an assembly fixture, for final assembly of locomotive components such as the engine, alternator, cooling system, etc. ("dead load" applied). This fourth fixture is flat, i.e., non-cambered, or uncambered, such that as the components are added to the carbody 10, the weight of the components causes the carbody 10 to deflect to a flat, substantially non-cambered (uncambered) configuration which will result in a calculated design load stress. In an embodiment, the carbody 10 is designed with a cambered under frame such that the carbody 10 has a zero camber platform or under frame under fully serviced, stationary configuration.

As the residual stress in the carbody 10 in the cambered position is approximately zero, the calculated design load stress can be confidently pushed up to 100% of allowable stress, as additional margin to account for uncertainty in residual stress is not needed. As a result, the carbody 10 can be optimized for lower overall weight and cost. In particular, the carbody 10, having approximately zero residual stress in the cambered position, obviates the need to add additional structural members or thicker structural members for structural reinforcement to compensate for an unknown residual stress value. Accordingly, the weight of the carbody 10 is reduced.

In connection with the above, allowable stress in any structure, such as a locomotive carbody, equals dead load stress, plus operational stress, plus residual stress. "Dead load stress" includes the weight of the equipment carried by the carbody, such as the engine, generators, cooling system, etc. "Operational stress" is the stress resulting from pulling or pushing a train carrying a load. As will be readily appreciated, dead load stress and operational stress can be calculated substantially exactly, as the weight of the locomotive components and the pulling force of the train with respect to anticipated loads is known. Existing locomotive carbodies are manufactured in such a manner, however, that residual stress is inherent in the design. The amount of residual stress in the carbody is unpredictable and unknown and, as such, the total stress in the carbody cannot be exactly calculated. As a result of the unknown value of residual stress in known locomotive carbodies, the dead load stress plus operational stress (i.e., calculated stress) must be kept to approximately 80% of the allowable stress. This factor of safety is needed to ensure that the unknown residual stress in the carbody does not push the actual, total stress in the carbody past allowable limits.

In contrast to known carbodies and methods of manufacturing the same, the carbody 10 of the present invention has substantially zero residual stress in the cambered position as a result of the degree of play permitted by the inclusion of the upper and lower slip joint plates. Because there is no residual stress in the carbody, residual stress is not included in the total stress equation and the dead load stress plus the operational stress can confidently be pushed up to 100% of the allowable stress, as discussed above. In an embodiment, as used herein, substantially zero residual stress means a nominal amount of residual stress. In an embodiment, substantially zero residual stress means less than 20% of the allowable stress. In an embodiment, substantially zero residual stress may be between zero residual stress and less than 20% of the allowable stress. Preferably, however, substantially zero residual stress is in the range of zero residual stress to about 3% of the total allowable stress.

In an embodiment, a method of manufacturing a vehicle body includes coupling a frame assembly to a platform, wherein the platform is in a cambered and unloaded condition, and wherein the frame assembly has a degree of play at coupling points with the platform, and securing the coupling points to eliminate the degree of play and thereby to provide substantially zero residual stress in the vehicle body in the cambered condition. The platform may be assembled in the cambered condition in a first fixture and may include a plurality of distinct sections. The magnitude of camber in the platform may be pre-determined by finite element analysis. The platform may be loaded so as to change the platform condition from the cambered and unloaded condition to an uncambered and loaded condition. Loading the platform may include adding a dead load to the platform such that the summation of a calculated dead load stress and an operational stress is approximately 100% of the allowable stress in the vehicle body. The frame assembly can be coupled to the platform at a second fixture having a plurality of vertical stops corresponding to the magnitude of camber in the platform. The frame assembly may include a plurality of distinct sidewall sections coupled to the platform individually. The method may further include coupling at least one of the plurality of distinct sidewall sections to another of the plurality of distinct sidewall sections such that at least one of the plurality of distinct sidewall sections has a degree of play at sidewall coupling points with the another of the distinct sidewall sections. The sidewall coupling points may then be secured to eliminate the degree of play and thereby to provide substantially zero residual stress in the vehicle body in the cambered condition.

In another embodiment, a vehicle body includes an under frame that is movable under load between a cambered position and a non-cambered position and an upper frame secured to the under frame. When the under frame is in the cambered position and the upper frame is secured to the under frame there is substantially zero residual stress present in both the upper frame and the under frame. The under frame may include a plurality of distinct sections that are welded together in the cambered position. The upper frame may include a plurality of distinct sidewall sections including at least a center sidewall section and two end sidewall sections. The upper frame may be secured to the under frame through at least one lower slip joint plate, wherein the lower slip joint plate provides for a degree of play between upper frame and the under frame. At least one of the plurality of distinct sidewall sections may be secured to another of the distinct sidewall sections through an upper slip joint plate, wherein the upper slip joint plate provides for a degree of play between the distinct sidewall sections. The vehicle body may also include at least one operational cab coupled to the upper frame. Moreover, the vehicle body may include a plurality of operational components defining a dead weight coupled to the vehicle body such that the dead weight causes the under frame to move to the non-cambered position and such that the summation of a dead load stress resulting from the dead weight and an operational stress is approximately 100% of the allowable stress in the vehicle body.

In another embodiment, a vehicle having a body includes a platform assembly movable under load between a cambered position and a substantially non-cambered position, a frame assembly having a plurality of structural members and, a first slip joint plate securing the upper frame to the platform assembly. The first slip joint plate is matingly engagable to at least one of the structural members of the frame assembly and is fixedly attached to the platform assembly such that substantially zero residual stress is exhibited in the body when the platform is in the cambered position. The frame assembly may include a plurality of distinct sidewall sections wherein at least one of the sidewall sections has a second slip joint plate matingly engagable to at least one of the structural members of another of the sidewall sections. The platform assembly may a plurality of distinct sections welded together in the cambered position.

In yet another embodiment, a method includes assembling a frame of a vehicle in a substantially non-cambered position, assembling a platform of a vehicle in a cambered position, securing the non-cambered frame to the cambered platform with little or no stress between the frame and the platform when the vehicle is in the cambered position and loading the cambered vehicle to reduce the degree of camber to about zero degrees of camber.

In yet another embodiment, a method includes selecting a structure and materials that are only necessary to provide a substantially 1:1 ratio of calculated stress to allowable stress in a vehicle body, wherein the calculated stress includes substantially zero residual stress. The method may further include assembling a frame of the vehicle in a substantially non-cambered position, assembling a platform of the vehicle in a cambered position, securing the non-cambered frame to the cambered platform in a manner so as to provide the substantially 1:1 ratio of calculated stress to allowable stress wherein the calculated stress includes substantially zero residual stress when the vehicle is in the cambered position, and loading the cambered vehicle to reduce the degree of camber to about zero degrees of camber.

In embodiments, upon completing manufacturing of the body (e.g., upper frame finally secured to under frame), there is substantially zero residual stress present in the body, e.g., substantially zero residual stress present in both the upper frame and the under frame. In embodiments, the zero residual stress is of components of the body that are operationally load bearing (that is, they bear a portion of the entire load of the body). Thus, components that are attached to the body, but are not load bearing, are not considered to impart residual stress to the body even if such components themselves have internal residual stress.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-method of manufacturing a vehicle body, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A method of manufacturing a vehicle body, comprising:

coupling a frame assembly to a platform, wherein the platform is in a cambered and unloaded condition, and wherein the frame assembly is in a flat and un-cambered condition, the step of coupling the frame assembly to the platform including:

breaking a tack weld between at least one frame member of the frame assembly and a slip joint plate of the frame assembly to permit a degree of play between the at least one frame member and the slip joint plate;

sliding the slip joint plate relative to the at least one frame member to place the slip joint plate in flat registration with the platform at coupling points with the platform;

securing the slip joint plate to the platform; and securing coupling points between the slip joint plate and the at least one frame member to eliminate the degree of play between the slip joint plate and the at least one frame member and thereby to provide substantially zero residual stress in the vehicle body in the cambered condition.

2. The method according to claim 1, wherein: the substantially zero residual stress in the vehicle body is substantially zero residual stress in components of the body that are operationally load bearing.

3. The method according to claim 1, further comprising: loading the platform so as to change the platform condition to an uncambered and loaded condition.

4. The method according to claim 3, wherein: loading the platform includes adding a dead load to the platform such that the summation of a calculated dead load stress and an operational stress is approximately 100% of an allowable stress in the vehicle body.

5. The method according to claim 1, further comprising: pre-determining a magnitude of camber in the platform through finite element analysis.

6. The method according to claim 1, wherein: the platform includes a plurality of distinct sections and is assembled in the cambered condition in a fixture.

7. The method according to claim 1, wherein: the frame assembly is coupled to the platform at a fixture, the fixture having a plurality of vertical stops corresponding to a magnitude of camber in the platform.

8. The method according to claim 1, wherein: the frame assembly includes a plurality of distinct sidewall sections, the distinct sections each being coupled to the platform individually.

9. The method according to claim 8, further comprising:

coupling at least one of the plurality of distinct sidewall sections to another of the plurality of distinct sidewall sections, and wherein the at least one of the plurality of distinct sidewall sections has a degree of play at sidewall coupling points with the another of the distinct sidewall sections; and securing the sidewall coupling points to eliminate the degree of play and thereby to provide substantially zero residual stress in the vehicle body in the cambered condition.

10. A method of manufacturing a rail vehicle body, comprising:

coupling a rail vehicle frame assembly to a rail vehicle platform, wherein the platform is in a cambered and unloaded condition, and wherein the frame assembly is in a flat and un-cambered condition, the step of coupling the frame assembly to the platform including:

breaking a tack weld between at least one frame member of the frame assembly and a slip joint plate of the frame assembly to permit a degree of play between the at least one frame member and the slip joint plate;

sliding the slip joint plate relative to the at least one frame member to place the slip joint plate in flat registration with the platform at coupling points with the platform;

securing the slip joint plate to the platform; and securing coupling points between the slip joint plate and the at least one frame member to eliminate the degree of play between the slip joint plate and the at least one frame member and thereby to provide substantially zero residual stress in the vehicle body in the cambered condition.

11. The method according to claim 10, wherein: the substantially zero residual stress in the vehicle body is substantially zero residual stress in components of the body that are operationally load bearing.

12. The method according to claim 10, further comprising: loading the platform so as to change the platform condition to an uncambered and loaded condition.

13. The method according to claim 12, wherein: loading the platform includes adding a dead load to the platform such that the summation of a calculated dead load stress and an operational stress is approximately 100% of an allowable stress in the vehicle body.

14. The method according to claim 10, further comprising: pre-determining a magnitude of camber in the platform through finite element analysis.

15. The method according to claim 10, wherein: the platform includes a plurality of distinct sections and is assembled in the cambered condition in a fixture.

16. The method according to claim 10, wherein: the frame assembly is coupled to the platform at a fixture, the fixture having a plurality of vertical stops corresponding to a magnitude of camber in the platform.

17. The method according to claim 10, wherein: the frame assembly includes a plurality of distinct sidewall sections, the distinct sections each being coupled to the platform individually.

18. The method according to claim 17, further comprising:

coupling at least one of the plurality of distinct sidewall sections to another of the plurality of distinct sidewall sections, and wherein the at least one of the plurality of distinct sidewall sections has a degree of play at sidewall coupling points with the another of the distinct sidewall sections; and securing the sidewall coupling points to eliminate the degree of play and thereby to provide substantially zero residual stress in the vehicle body in the cambered condition.

* * * * *